US007717403B2

(12) United States Patent
Zbytowski

(10) Patent No.: US 7,717,403 B2
(45) Date of Patent: May 18, 2010

(54) ACCELERATOR DEVICE FOR A CARBURETOR

(75) Inventor: Eric G. Zbytowski, Alpena, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 263 days.

(21) Appl. No.: 12/036,696

(22) Filed: Feb. 25, 2008

(65) Prior Publication Data

US 2008/0211116 A1 Sep. 4, 2008

(30) Foreign Application Priority Data

Mar. 2, 2007 (JP) ..... 2007-052334

(51) Int. Cl.
*F02M 7/08* (2006.01)

(52) U.S. Cl. ..... 261/34.2

(58) Field of Classification Search ..... 261/34.2, 261/51, 60

See application file for complete search history.

(56) References Cited

U.S. PATENT DOCUMENTS 1,933,395 A * 10/1933 Skoogh ..... 261/34.2
1,949,031 A * 2/1934 Weber ..... 261/34.2
2,021,695 A * 11/1935 Messinger, Jr. ..... 261/34.2
2,529,655 A * 11/1950 Henning ..... 261/34.2
2,919,908 A * 1/1960 Newman ..... 261/34.2
3,281,128 A * 10/1966 Phillips ..... 261/34.2
3,730,495 A * 5/1973 Elam ..... 261/34.2
4,076,770 A * 2/1978 Saito et al. ..... 261/34.2
4,106,464 A * 8/1978 Yamashita et al. ..... 123/179.16
5,250,233 A 10/1993 Swanson
6,293,524 B1 9/2001 Endo et al.
7,000,906 B2 * 2/2006 Geyer et al. ..... 261/34.2
7,210,672 B2 * 5/2007 Ishii ..... 261/34.2
7,467,785 B2 * 12/2008 Braun ..... 261/34.2
2002/0158349 A1 * 10/2002 Osburg et al. ..... 261/34.2
2002/0163087 A1 * 11/2002 Gerhardy ..... 261/34.2
2007/0052116 A1 * 3/2007 Ishii ..... 261/34.2

FOREIGN PATENT DOCUMENTS

JP 60-75750 A * 4/1985 ..... 261/34.2

* cited by examiner

*Primary Examiner*—Richard L Chiesa
(74) *Attorney, Agent, or Firm*—Reising Ethington P.C.

(57) ABSTRACT

According to one implementation, a carburetor includes an intake bore, a throttle valve, a main fuel nozzle, an accelerator device and a fuel passage. The throttle valve is movable between an idle and wide open positions and includes a shaft rotatably supported around an axial line extending across the intake bore. The accelerator device may be operable to increase an amount of fuel that flows through the main fuel nozzle when the throttle valve is moved toward its wide open position, and may include a fuel reservoir constructed and arranged to store fuel. The fuel passage communicates with the main fuel nozzle and the fuel reservoir is provided upstream of the main fuel nozzle such that fuel flows through the fuel reservoir before being delivered to the main fuel nozzle.

17 Claims, 2 Drawing Sheets

ACCELERATOR DEVICE FOR A CARBURETOR

REFERENCE TO RELATED APPLICATION

Applicant claims priority from Japanese Patent Application Ser. No. 2007-52334, filed Mar. 2, 2007.

FIELD OF THE INVENTION

The present invention relates generally to carburetors and more particularly to an accelerator device for a carburetor.

BACKGROUND OF THE INVENTION

Some small internal combustion engines for handheld power tools such as chain saws, grass trimmers, weed trimmers, leaf blowers, and the like have carburetors with an internal accelerator pump which supplies additional fuel to the operating engine as the throttle valve of the carburetor is opened from its essentially closed or idle position toward its wide open throttle position. The accelerator device can temporarily increase the amount of fuel delivered to the engine when the throttle valve is opened fully for improving the acceleration of the engine. This additional fuel is needed to smoothly and rapidly accelerate the engine without stumbling, particularly when the engine is under a load.

SUMMARY OF THE INVENTION

According to one implementation, a carburetor includes an intake bore, a throttle valve, a main fuel nozzle opening into the intake bore, an accelerator device and a fuel passage. The throttle valve is movable between an idle and wide open positions to control fluid flow through the intake bore and includes a shaft rotatably supported around an axial line extending across the intake bore. The accelerator device may be operable to increase an amount of fuel that flows through the main fuel nozzle when the throttle valve is moved toward its wide open position, and may include a fuel reservoir constructed and arranged to store fuel. The fuel passage communicates with the main fuel nozzle, and may include a first portion communicating with a fuel metering chamber, and a second portion communicating with the main fuel nozzle. The fuel reservoir is provided between the first fuel passage portion and the second fuel passage portion and forms a part of the fuel passage and fuel flows through the fuel reservoir and to the main fuel nozzle both when the throttle valve is opened and when the throttle valve is closed.

According to at least one implementation, a carburetor includes an intake bore from which fuel and air are discharged from the carburetor, a fuel chamber from which fuel is supplied within the carburetor, a main fuel nozzle communicating with the fuel chamber and the intake bore and through which fuel flows into the intake bore, a fuel passage communicating with the fuel chamber and the main fuel nozzle, and an accelerator device for increasing an amount of fuel provided to the main fuel nozzle during acceleration of an engine with which the carburetor is used, the accelerator device including a fuel reservoir constructed and arranged to store fuel wherein the fuel reservoir defines at least part of the fuel passage so that fuel flows through the fuel reservoir before the main fuel nozzle.

BRIEF DESCRIPTION OF THE DRAWINGS

These and other objects, features and advantages of the present invention will be apparent from the following detailed description of the preferred embodiments and best mode, appended claims and accompanying drawings in which:

DETAILED DESCRIPTION OF PREFERRED EMBODIMENTS

Figure 1:
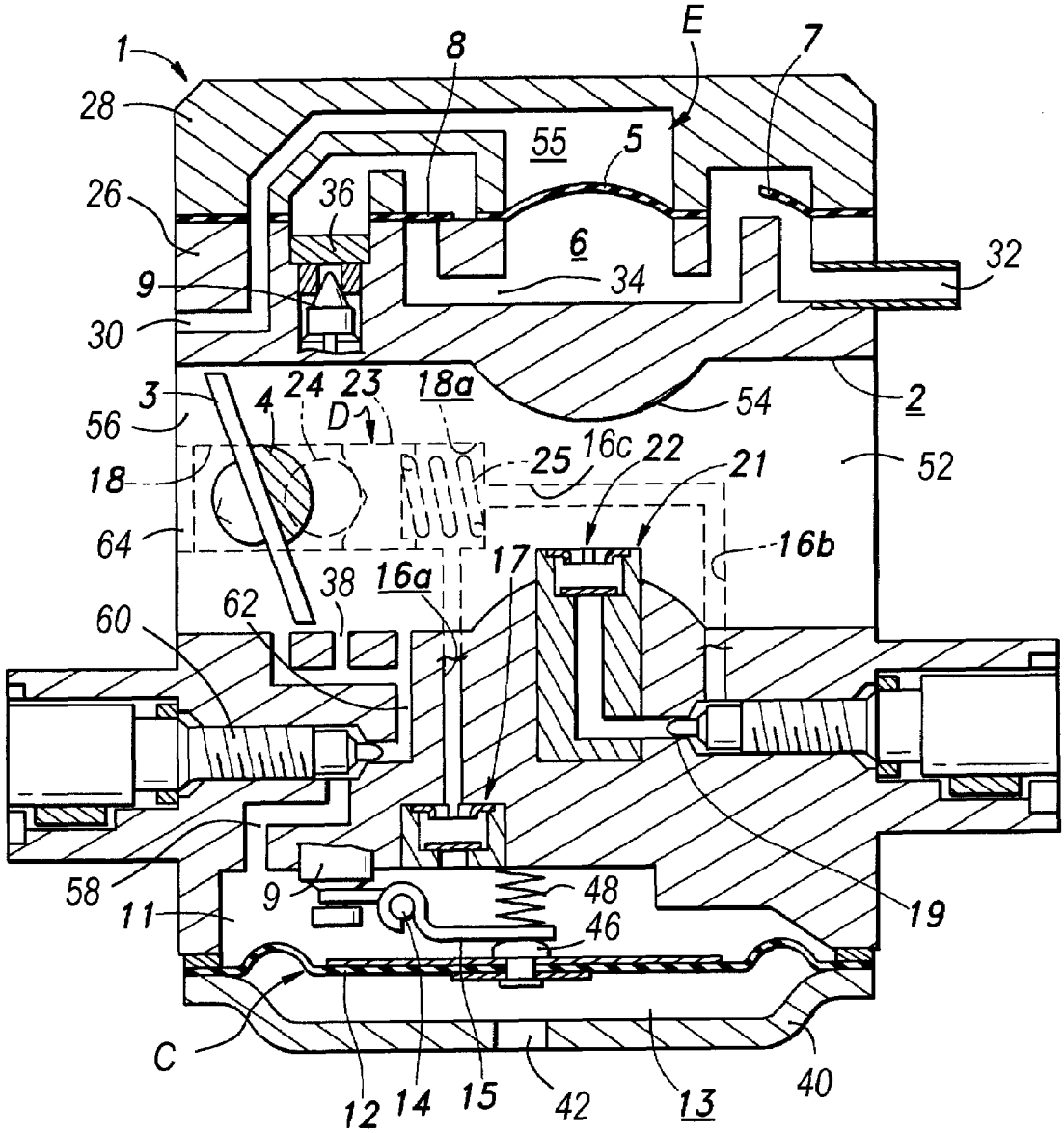
FIG. 1 is a partly broken away sectional view of one embodiment of a carburetor.

Referring in more detail to the drawings, FIG. 1 illustrates one embodiment including a diaphragm type carburetor 1 for an internal combustion gasoline fueled engine with an accelerator device or pump D. The carburetor 1 may be used, for example, in a small general-purpose internal combustion engine. The diaphragm carburetor 1 also has a fuel supply pump assembly E and a fuel metering system C, each of which, if desired, may be of conventional construction. In one embodiment, the carburetor 1 may be a butterfly valve type carburetor.

When the engine is operating, the fuel pump assembly E supplies fuel to the metering system C of the carburetor 1. The fuel pump assembly E has a flexible diaphragm or membrane 5 received and sealed between an upper face of the carburetor body 26 and a lower face of an upper cover 28 and defining in part a fuel pump chamber 6 and a pulsating pressure chamber or pulse chamber 55 to which pressure and vacuum pulses in the crankcase of an operating engine are introduced through a passage 30 to displace or actuate the diaphragm 5. The fuel pump chamber 6 communicates with an external fuel tank (not shown) via an inlet passage 32 formed in the carburetor main body and a one-way check valve 7 and a reciprocating movement of the diaphragm 5 caused by the pulsating pressure draws fuel from the fuel tank and feeds it into the pump chamber 6. The movement of the diaphragm 5 draws the fuel through inlet passage 32 and one-way check valve 7 into the pump chamber 6 and supplies the fuel under pressure through an outlet passage 34, one-way check valve 8, and a screen 36, to the fuel metering system C through a flow control valve 9. A fuel-intake movement of the pump diaphragm 5 causes the check valve 8 to close and the check valve 7 to open and to thereby allow fuel to be drawn from the fuel tank. A fuel expelling movement of the pump diaphragm 5 causes the check valve 8 to open and the check valve 7 to close and to thereby force the fuel from the fuel tank into a fuel chamber or fuel metering chamber 11 of the fuel metering system C through which fuel is supplied within the carburetor.

The fuel metering system C has a flexible diaphragm or membrane 12 received and sealed between a lower face of the carburetor body 26 and a lower cover 40. The diaphragm 12 defines on one side the fuel metering chamber 11 and on the other side an atmospheric air chamber 13. The atmospheric air chamber 13 communicates with the atmosphere exteriorly of the carburetor through a port 42 in the lower cover 40. The flow valve 9 is opened and closed to control the admission of fuel to chamber 11 by movement of the diaphragm 12 which is operably connected to the valve 9 by a lever 15. At one end, the lever 15 is connected to the flow valve 9, and at the other end the lever 15 bears on a projection 46 attached to the center of the diaphragm 12. The lever 15 is rotatably supported by a pivot shaft 14 and yieldably biased by a spring 48 bearing on the lever 15 to bias the valve 9 to its closed position. In one embodiment, the lever 15 is resiliently urged in the direction to abut an end of the lever 15 against projection 46.

When the pressure of the atmospheric chamber 13 is higher than the pressure of the fuel metering chamber 11 to such an extent that the diaphragm 12 is displaced in a direction reducing the volume of the fuel metering chamber 11, the projection 46 pushes on and moves the lever 15 about its pivot 14, and the resulting counter clockwise rotation of the lever 15 opens the fuel feed control valve 9. Fuel then flows into the fuel metering chamber 11.

The carburetor 1 has an intake bore or air and fuel mixing passage 2 with an air inlet 52, downstream of the inlet a restricted venturi section 54, and downstream of the venturi 54 an outlet 56 which communicates with an intake passage of the engine. A throttle valve head 3 is received in the intake bore 2 downstream of the venturi 54 and is mounted on a throttle valve shaft 4 extending transversely through the bore and journalled for rotation in the carburetor body 26.

In operation of the carburetor 1, fuel is supplied from the metering chamber 11 to a main fuel nozzle 21 opening into the intake bore 2 via a check valve 17, a first fuel passage 16*a*, a fuel reservoir chamber 18*a*, a second fuel passage 16*b*, a fuel metering needle valve 19, and a check valve 22. Fuel is also supplied from the metering chamber 11 to a series of low speed fuel nozzles or ports 38 which may open into the intake bore 2 both upstream and downstream of the throttle valve 3 in its idle or closed position, via a passage 58, an adjustable low speed fuel regulating needle valve 60, and a passage 62.

In operation, air flowing through the intake bore 2 creates a pressure differential causing fuel to flow through the low speed nozzle 38 downstream of the throttle valve 3 (in its idle position) into the intake bore 2 and in the engine under idle and near idle operating conditions, and to flow through the main fuel nozzle 21 into the intake bore 2 and the engine when the engine is in the range from near idle to wide open throttle operating conditions. This pressure differential acts on the diaphragm 12 to open and close the valve 9 to maintain a predetermined quantity of fuel in the metering chamber 11 and at a substantially constant pressure when the engine is operating to supply fuel to the low speed nozzle 38 and the main fuel nozzle 21.

As shown in FIG. 1, in one embodiment the accelerator device or pump D is provided inside the carburetor body 26 adjacent the throttle shaft 4 in an area spaced or remote from or outside of the intake bore 2. The accelerator pump D may increase the amount of fuel discharged from the main fuel nozzle 21 and into the intake bore 2 when opening the throttle valve 3. The accelerator pump D may include a piston 23 axially slidably received in a cylindrical chamber 18 and a cam 4*a* which may be carried by or formed in the throttle valve shaft 4. In one embodiment the piston 23 may be a short, cylindrically shaped piston. In one embodiment, the other end of the cylindrical chamber 18 is closed by a plug 64 press fit therein. A fuel reservoir chamber 18*a* is defined by the cylindrical chamber 18 and an end surface of the piston 23. The fuel reservoir chamber 18*a* is configured to store fuel and communicates with both the fuel metering chamber 11 and the main fuel nozzle 21. The accelerator pump D draws fuel into the fuel reservoir chamber 18*a* when closing the valve 3 and expels fuel out of the fuel reservoir chamber 18*a* when opening the valve 3, in synchronism with a valve opening and closing movement of the valve shaft 4.

The piston 23 may be located laterally adjacent to the intake bore 2. The intake bore 2 includes a block member to communicate an upstream part of an intake passage with a downstream part thereof. The valve 3 is provided in the downstream part of the intake bore 2 to selectively close and open the intake bore 2. The valve 3 may be integrally secured, for example by using screws, to a valve shaft 4. The valve shaft 4 may be rotatably supported around an axial line extending perpendicularly to the intake bore 2 or across the intake bore 2. An end of the valve shaft 4 that extends out of the carburetor main body is fixedly fitted with a throttle lever (not shown) so that the intake bore 2 can be opened and closed by actuating the throttle lever.

The first fuel passage 16*a* communicates with the fuel metering chamber 11 and the chamber 18*a*. The check valve 17 may comprise a disk-shaped valve member which is configured to selectively close the first fuel passage 16*a* facing the fuel metering chamber 11 under gravitational force and to be lifted by the force of the flow of fuel, and comprises a retainer that limits the opening movement of the valve member and has a cutout or holes to permit the flow of fuel through the retainer even when the valve member is engaged with the retainer.

The first fuel passage 16*a* and the second fuel passage 16*b* open into the fuel reservoir 18*a*. The fuel reservoir 18*a* may be provided in an intermediate part of the overall fuel passage 16*c* comprising the first and second fuel passages 16*a* and 16*b*, and forms a part of the fuel passage 16*c*. The fuel passage 16*c* communicates with and may extend from the fuel metering chamber 11 to the main fuel nozzle 21 and passes through and/or includes the fuel reservoir 18*a*. The first fuel passage 16*a* communicates with the second fuel passage 16*b* via the fuel reservoir 18*a*. The second fuel passage 16*b* communicates with a main fuel nozzle 21 via the fuel metering needle valve 19. The main fuel nozzle 21 may have the shape of a cylindrical cup, and may include a head formed with a fuel ejection orifice and projecting into the venturi 54 formed in the intake bore 2. The fuel ejection orifice may be selectively closed by the check valve 22. In one embodiment, the check valve 22 may have an identical structure as the check valve 17.

Figure 2:
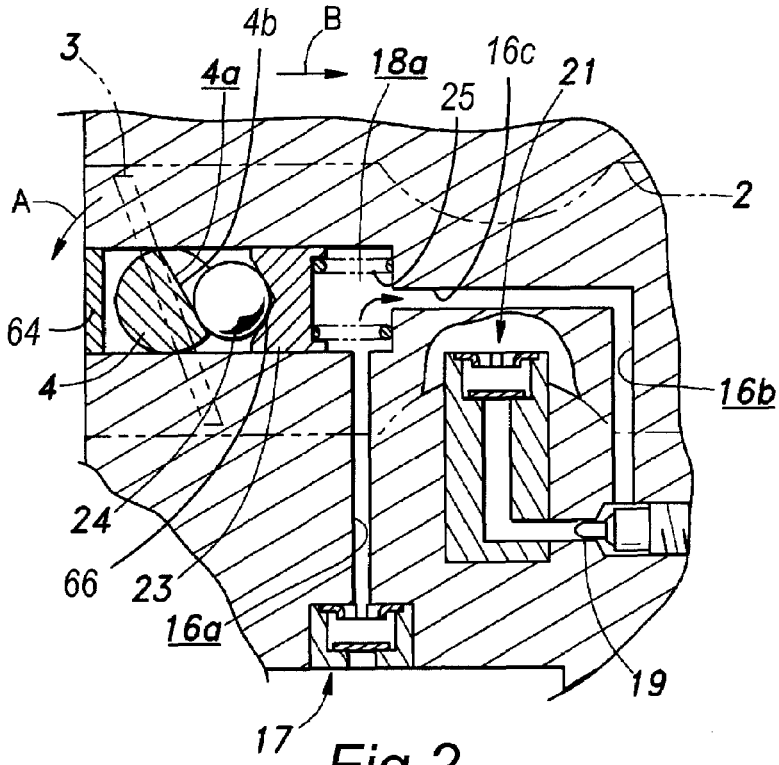
FIG. 2 is a fragmentary sectional view of the carburetor of FIG. 1 showing a throttle valve in its idle position.
Figure 3:
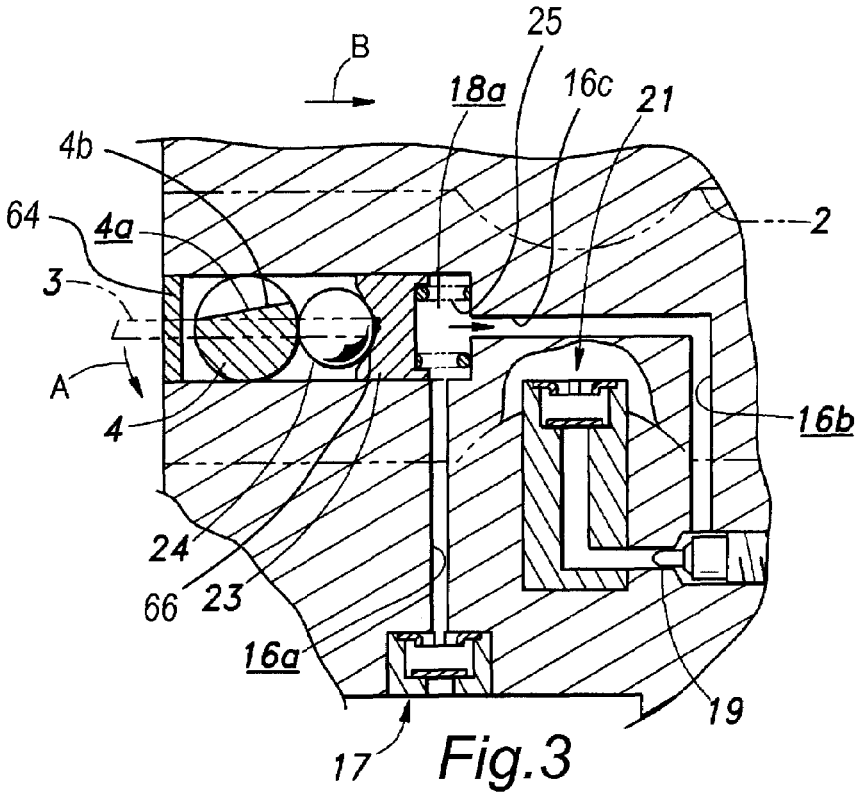
FIG. 3 is a fragmentary sectional view of the carburetor of FIG. 1 showing the throttle valve in its wide open position.

The valve shaft 4 extends across a part of the cylinder chamber 18 that is located on the opposite side of the fuel reservoir 18*a* with respect to the piston 23. A ball 24 is disposed in the cylinder chamber 18 and between the valve shaft 4 and the piston 23. In this implementation, the piston 23 is actuated by a cam 4*a* that is connected to, carried by or actuated by the valve shaft 4 and engages the spherical ball 24 disposed between them and received in a recess 66 in an end of the piston 23. As shown in FIGS. 2 and 3, the valve shaft 4 may include a portion with a D-shaped cross section defining at least part of the cam 4*a* in this implementation. The cam 4*a* displaces the piston 23 in synchronism with a valve opening and closing movement of the valve shaft 4.

In one embodiment, a seal may be provided between the piston 23 and the bore 18 by an O-ring (not shown) and the piston 23 is yieldably biased towards its retracted position and into engagement with the ball 24 which in turn is urged into engagement with the cam 4*a* by a spring 25 received in the reservoir 18*a* and bearing on the piston 23. In one implementation, the cam 4*a* consists of a flat cutout surface 4*b* of the throttle shaft 4. In the fully closed state of the throttle valve 3 illustrated in FIG. 2, the ball 24 engages the cutout surface 4*b* so that the volume of the fuel reservoir 18*a* is maximized.

Referring to FIG. 2, when the valve shaft 4 is turned in the direction indicated by arrow A (or counter clockwise as viewed in FIG. 2) to open the throttle valve, the ball 24 is displaced toward the piston 23 so that the piston 23 is displaced in the direction indicated by arrow B (FIG. 3). In this manner, the movement of the piston 23 resulting from the rotation of the valve shaft 4 toward the fully open position reduces the volume of the fuel reservoir 18*a*, and the amount of the fuel corresponding to the reduction in the volume of the reservoir 18*a* is moved into the fuel passage 16*b*. Because the first fuel passage 16*a* has the check valve 17, the fuel that is pushed out from the fuel reservoir 18*a* is forwarded to the second fuel passage 16*b*, and discharged into the intake bore 2 via the main fuel nozzle 21. Therefore, the amount of fuel ejection can be increased at the time of opening the throttle valve, and a favorable acceleration performance can be achieved.

When the valve shaft 4 is turned from the state illustrated in FIG. 3 (fully open state) in the valve closing direction, the ball 24 rides onto the flat cutout surface 4*b* of the valve shaft 4. The further rotation of the valve shaft 4 in the valve closing direction allows the point of contact between the cutout surface 4*b* and the ball 24 to move away from the fuel reservoir 18*a*. Because the return spring 25 urges the piston 23 toward the valve shaft 4, the piston 23 is pushed back to the initial position (fully closed position).

As can be appreciated from the foregoing description, the fuel reservoir 18*a* may be provided in an intermediate part of the fuel passage 16*c* and forms a part of the fuel passage 16*c* through which the fuel flows from the metering chamber 11 to the intake passage 2. Even when the accelerator pump D is not operating, fuel flows to the main fuel nozzle 21 through the fuel passage 16*c*. All the fuel therefore passes through the fuel reservoir 18*a* before being delivered to and expelled from the main fuel nozzle 21. If bubbles are produced in the first and second fuel passages 16*a* and 16*b* due to the transfer of heat from the engine main body and/or the vibrations of the carburetor main body 1, or for any other reason, the bubbles are carried away by the flow of the fuel through the fuel passage 16*c* and do not remain trapped in the fuel reservoir 18*a*. As a result, when the amount of fuel to be discharged through the main fuel nozzle 21 is temporarily increased by opening the throttle valve 3, this fuel contains few, if any, bubbles, and a favorable accelerating performance can be achieved at all times. This may not be true in accelerator pump arrangements wherein a reservoir is disposed downstream of the main fuel nozzle and communicates therewith by a branch passage. When the accelerator pump is not operating, fuel does not flow through the reservoir but rather passes directly to a fuel nozzle and hence, vapor bubbles may collect or increasingly form in the reservoir and thereby reduce the volume available for liquid fuel. When this happens, less fuel is displaced by the accelerator pump and engine performance can be adversely affected.

In the embodiments shown in the figures, the pump arrangement includes a piston slidably received in a cylinder or chamber to move fuel into and out of the chamber. In other embodiments, the pump arrangement is not limited by such a cylinder/piston pump, but may consist of any pump as long as it is capable of achieving a pump action in synchronism with the rotation of the valve shaft 4. Likewise, the throttle valve is shown as a butterfly type-throttle valve but other construction and arrangements may be used. Still other modifications and alternatives are possible and contemplated to be within the scope of the following claims.

The invention claimed is:

1. A carburetor, comprising:

an intake bore and a fuel chamber from which fuel is supplied within the carburetor;

a throttle valve movable between idle and wide open positions to control fluid flow through the intake bore;

a main fuel nozzle opening into the intake bore and communicating with the fuel chamber;

an accelerator device for increasing an amount of fuel ejection from the main fuel nozzle when the throttle valve is moved toward its wide open position, and including a fuel reservoir constructed and arranged to store fuel; and a fuel passage communicating with the main fuel nozzle, comprising a first fuel passage portion communicating with a fuel metering chamber, and a second fuel passage portion communicating with the main fuel nozzle wherein the fuel reservoir is provided between the first fuel passage portion and the second fuel passage portion and forms a part of the fuel passage and fuel flows through the fuel reservoir and to the main fuel nozzle both when the throttle valve is opened and when the throttle valve is closed.

2. The carburetor according to claim 1 wherein the accelerator device draws fuel into the fuel reservoir when closing the throttle valve and expels fuel out of the fuel reservoir when opening the throttle valve, in synchronism with the movement of the throttle valve.

3. The carburetor according to claim 1 wherein the throttle valve further comprises a shaft rotatably supported around an axial line extending across the intake bore and the accelerator device further comprises a piston and a cam responsive to movement of the throttle valve shaft to displace the piston in synchronism with the movement of the throttle valve.

4. The carburetor according to claim 3 further comprising a ball received between and bearing on the cam and the piston so that rotation of the throttle valve shaft to move the throttle valve from the idle position to the wide open throttle position causes the cam to move the ball which in turn moves the piston to decrease the volume of the fuel reservoir and displace fuel therefrom.

5. The carburetor according to claim 4 further comprising a spring in the fuel reservoir chamber to yieldably bias the piston into engagement with the ball.

6. The carburetor according to claim 3 wherein the cam includes a flat surface of the throttle shaft.

7. A carburetor, comprising:

a body;

an intake bore through the body;

a fuel metering chamber carried by the body;

a main fuel nozzle communicating with the fuel metering chamber and with the intake bore;

a throttle valve shaft rotatably supported around an axial line extending across the intake bore;

a throttle valve in the intake bore, connected to the throttle valve shaft and movable by rotation of the shaft between an idle position in which the throttle valve substantially closes the intake bore and a wide open throttle position of the throttle valve, a cam responsive to movement of the throttle valve shaft;

an accelerator device for increasing an amount of fuel flow through the main fuel nozzle when opening the throttle valve, comprising a cylindrical chamber laterally adjacent to the intake bore and a fuel reservoir constructed and arranged to store fuel and positioned in the cylindrical chamber;

a fuel passage for conducting fuel to the main fuel nozzle comprising a first portion connected to the fuel metering chamber, and a second portion connected to the main fuel nozzle;

wherein the fuel reservoir chamber is provided between the first portion and the second portion and forms a part of the fuel passage; and wherein fuel flows through the fuel passage, including the fuel reservoir, and to the main fuel nozzle both when the throttle valve is opened and when the throttle valve is closed.

8. The carburetor according to claim 7 wherein the accelerator device draws fuel into the fuel reservoir when closing the throttle valve and expels fuel out of the fuel reservoir when opening the throttle valve.

9. The carburetor according to claim 7 wherein the accelerator device further comprises a piston received in the cylinder chamber for reciprocating movement therein, and wherein the cam displaces the piston in synchronism with a valve opening and closing movement of the throttle valve shaft.

10. The carburetor according to claim 9 further comprising a ball received between and bearing on the cam and the piston so that rotation of the throttle valve shaft to move the throttle valve from the idle position to the wide open throttle position moves the piston to deliver a quantity of fuel into the intake bore.

11. The carburetor according to claim 10 further comprising a spring in the fuel reservoir chamber to urge the piston to bear on the ball.

12. The carburetor according to claim 7 wherein the cam comprises a flat surface of the throttle valve shaft.

13. A carburetor, comprising:

an intake bore from which fuel and air are discharged from the carburetor;

a fuel chamber from which fuel is supplied within the carburetor;

a main fuel nozzle communicating with the fuel chamber and the intake bore and through which fuel flows into the intake bore;

a fuel passage communicating with the fuel chamber and the main fuel nozzle; and an accelerator device for increasing an amount of fuel provided to the main fuel nozzle during acceleration of an engine with which the carburetor is used, the accelerator device including a fuel reservoir constructed and arranged to store fuel wherein the fuel reservoir defines at least part of the fuel passage so that fuel flows through the fuel reservoir before the main fuel nozzle.

14. The carburetor according to claim 13 further comprising a throttle valve movable between idle and wide open positions to control fluid flow through the intake bore and wherein the accelerator device draws fuel into the fuel reservoir when closing the throttle valve and expels fuel out of the fuel reservoir when opening the throttle valve, in synchronism with the movement of the throttle valve.

15. The carburetor according to claim 13 wherein the throttle valve further comprises a shaft rotatably supported around an axial line extending across the intake bore and the accelerator device further comprises a piston and a cam responsive to movement of the throttle valve shaft to displace the piston in synchronism with the movement of the throttle valve.

16. The carburetor according to claim 15 further comprising a ball received between and bearing on the cam and the piston so that rotation of the throttle valve shaft to move the throttle valve from the idle position to the wide open throttle position causes the cam to move the ball which in turn moves the piston to decrease the volume of the fuel reservoir and displace fuel therefrom.

17. The carburetor according to claim 16 further comprising a spring in the fuel reservoir chamber to yieldably bias the piston into engagement with the ball.

* * * * *